US006581921B2

(12) United States Patent
Griggs

(10) Patent No.: US 6,581,921 B2
(45) Date of Patent: Jun. 24, 2003

(54) CABINET INSTALLATION DEVICE

(76) Inventor: Thomas Griggs, 4280 Chaires Cross Rd., Tallahassee, FL (US) 32317

( * ) Notice: Subject to any disclaimer, the term of this patent is extended or adjusted under 35 U.S.C. 154(b) by 0 days.

(21) Appl. No.: 10/123,988

(22) Filed: Apr. 18, 2002

(65) Prior Publication Data

US 2002/0171189 A1 Nov. 21, 2002

Related U.S. Application Data

(60) Provisional application No. 60/292,461, filed on May 21, 2001.

(51) Int. Cl.[7] ..... B25B 1/20

(52) U.S. Cl. ..... 269/37; 269/20; 269/904; 269/289 R; 254/93 H; 254/134

(58) Field of Search ..... 269/37, 20, 69, 269/289 R, 904; 254/122, 133 R, 134, 93 H, 100; 414/10, 800

(56) References Cited

U.S. PATENT DOCUMENTS

| | | | | | |
|---|---|---|---|---|---|
| 2,966,933 | A | | 1/1961 | Cooper | 214/1 |
| 4,128,234 | A | | 12/1978 | McKee | 269/97 |
| 4,160,539 | A | * | 7/1979 | Johnson | 254/106 |
| 4,275,778 | A | * | 6/1981 | Kotas | 254/93 H |
| 4,545,463 | A | * | 10/1985 | Olovsson | 187/9 R |
| 5,160,126 | A | | 11/1992 | Atkinson | 269/102 |
| 5,461,736 | A | * | 10/1995 | Carpenter et al. | 254/93 R |
| 5,645,272 | A | | 7/1997 | Brennan, Sr. | 269/68 |
| 5,680,688 | A | * | 10/1997 | Garner | 29/243.51 |
| 6,238,159 | B1 | * | 5/2001 | Pappas | 414/10 |
| 6,322,062 | B1 | * | 11/2001 | Conn et al. | 269/20 |

* cited by examiner

*Primary Examiner*—Lee Wilson
(74) *Attorney, Agent, or Firm*—Carnes Cona

(57) ABSTRACT

The present invention is a cabinet installation device that is simple in design so as to provide for an apparatus that is not only user friendly, but is successful in operation for achieving the desired results. Enabling such an apparatus, the present invention comprises a base that maintains and houses a support, lifting and lowering assembly. Extending upwardly from the base is a guide assembly. The guide aids during the lifting and lowering process. An access extends through the guide to provide access for the operation of the support and lifting assembly, known as the operational assembly.

4 Claims, 7 Drawing Sheets

CABINET INSTALLATION DEVICE

This is a utility Patent Application for Provisionally File Application No. 60/292,461 filed on May 21, 2001.

BACKGROUND OF THE INVENTION

1. Field of the Invention

The present invention relates generally to a cabinet installation device and more particularly to cabinet installation device which includes a support and lifting system that provides a means maintaining, lifting and supporting the cabinets during a typical installation process, inherently rendering a device that not only facilitates cabinet installation, but also enables cabinets to be installed by a single worker effectively, expeditiously and successfully.

2. Description of the Prior Art

Cabinet installation often requires the use of more than one person to complete the installation procedure. It is nearly impossible for one person to accurately support the cabinet weight at the correct height while sufficiently completing the installation procedure. In order to reduce additional work force requirements, as well as expedite the cabinet installation process, numerous devices have been developed, as evidenced by the prior art.

For example, in U.S. Pat. No. 5,160,126 issued to Atkinson there is disclosed a cabinet mounting apparatus specifically for use during positioning of a cabinet for mounting. Although this device may alleviate the need for additional individuals to complete the mounting process, the device is complex and bulky.

Another device that is used for lifting and maintaining cabinets during the installation process is disclosed in U.S. Pat. No. 4,128,234 issued to McKee. McKee discloses a cabinet installation tool device to aid a single person in installing wall cabinets which includes a frame of adjustable depth to be mounted across the top of a base cabinet, a vertical support member carried by the frame, a horizontal plate mounted atop the vertical support member for engaging the bottom of a wall cabinet with a means for adjusting the height of the vertical support member. Although this cabinet installation tool device may enable one person to successfully complete a wall cabinet installation, the device is bulky and requires numerous adjustments to align to the appropriate height requirements.

Other devices have been developed which concentrate on the process of lifting any larger and bulky load. For example in U.S. Pat. No. 5,645,272 issued to Brennan, Sr. there is disclosed is a multi-purpose work piece holder apparatus for panels or cabinets which will assist in holding, raising, and positioning the work piece into place.

Yet another example of a lifting apparatus is seen in U.S. Pat. No. 2,966,933 issued to Cooper wherein disclosed is a portable lifting device which via a portable jack provides lifting and stabilization of large items such as heavy boards or lumber for mounting on a ceiling or other elevated position. This lifting device is primarily used for lifting ceiling boards, large panels and other materials of this nature and require too much space when working in the restricted spaces associated with cabinet installation.

Though these devices may have proven to be successful in their scope of use, they address complex, bulky devices which are limited in there use and may require an adequate amount of space, as well as extensive training to accurately operate. What is needed is a cabinet installation device that is portable and compact in size so as to be easily stored and transported to any work site, and which is relatively compact in size to enable successful operation of the device, regardless as to the size of the work environment. Such a device should be efficient and appropriately sized so as to provide for a final product that is simple in design and structure and which will prove successful in operation so as to achieve the desired results.

Hence it is seen that none of these previous inventions provide the benefits intended with the present invention, such as providing a compact and portable cabinet installation device. Additionally, prior techniques do not suggest the present inventive combination of component elements as disclosed and claimed herein, such as the needs identified above. The present invention achieves its intended purposes by providing a cabinet installation device that is compact in size and successful during utilization. The cabinet installation device disclosed herein further meets its objectives and advantages over the prior art devices through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention is a cabinet installation device that is simple in design so as to provide for an apparatus that is not only user friendly, but is successful in operation for achieving the desired results. The purpose of the cabinet installation device of the present invention is to provide for an apparatus that will aid a cabinet installer. On this end, the present invention will include lifting and/or lowering capabilities so as to enable the installer to achieve the desire height for the particular cabinet. Once the height is met, the cabinet will be supported by the present invention. This will provide for the user to properly install the cabinet. Hence, it is seen that the present invention can allow the process of installing cabinets to be achieved by the use of a single worker so as to provide for a one-man operation.

Enabling such an apparatus, the present invention comprises a base that maintains and houses a support, lifting and lowering assembly. Optionally, extending upwardly from the base is a guide assembly. The guide aids during the lifting and lowering process. An access extends through the guide to provide access for the operation of the support and lifting assembly, known as the operational assembly.

The operational assembly comprises a lifting and lowering apparatus and used in the preferred embodiment is a conventional jack. This jack is secured to the base. Preferably, the jack is a hydraulically controlled assembly. However, this lifting and lowering apparatus can be any element that is capable of lifting and lowering, such as the use of a motor, a pneumatically controlled bladder or the like. Each lifting and lower apparatus will include a handle that is easy to grasp. So as to provide for a design the enables the user to comfortably and effectively use a hand or foot to for manipulating the present invention. A separate lowering pedal can be provided. This will provide for a device that includes separate handles for raising and/or lowering the operational assembly.

Secured to the tip of the operational assembly is a support plate. In one embodiment of the present invention, this support plate receives the cabinet.

In an optional design, secured to the support plate is a support sleeve. This sleeve includes an upper support and outer downwardly extending side walls. These downwardly extending side walls communicate with the support plate. Thus, the outer ends of the support plate are secured to the inner surface of the cowardly extending side wall.

To enhance the present invention, a height adjuster can be provided. The height adjuster is ideally suited for situations when additional height is desired, such as when installing a cabinet above the refrigerator. The height adjuster is placed over the present invention or optionally, the present invention is placed on top of the height adjuster.

To utilize the present invention, the operational assembly is lowered to its lowest position. The desired cabinet, which is to be installed, is placed on the particular support, this is dependent upon which embodiment is utilized. The operational assembly is raised to the desired position. Adjustments, such as raising or lowering the cabinet are made until the precise location is met. Once met, the cabinet is installed as deemed appropriate by the installer. When secured, the present invention is lowered for additional use or storage.

Accordingly, it is an object of the present invention to provide for a user friendly cabinet installation device which is compact, light in weight and simple to use and which will overcome deficiencies, shortcomings, and drawbacks of prior cabinet installation devices thereof.

Another object of the present invention is to provide for an apparatus, which will enable a one-man operation during the process of cabinet installation.

Still another object of the present invention is to provide for a cabinet installation device, which is able to achieve minute adjustments during the cabinet installation for the height necessary for proper installation.

A further object of the present invention to be specifically enumerated herein, is to provide a cabinet installation device in accordance with the preceding objects and which will conform to conventional forms of manufacture, be of simple construction and easy to use so as to provide a device that would be economically feasible, long lasting and relatively trouble free in operation.

Although there have been many inventions related to cabinet installation, none of the inventions have become sufficiently compact, low cost, and versatile enough to become commonly used. The present invention meets the requirements of the simplified design, compact size, low initial cost, low operating cost, ease of installation and maintainability and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the disclosed invention within the scope of the disclosure. Accordingly, a fuller understanding of the invention may be had by referring to the detailed description of the preferred embodiments in addition to the scope of the invention taken in conjunction with the claims and accompanying drawings.

BRIEF DESCRIPTION OF THE DRAWINGS

Similar reference numerals refer to similar parts throughout the several views of the drawings.

DESCRIPTION OF THE PREFERRED EMBODIMENT

Figure 1:
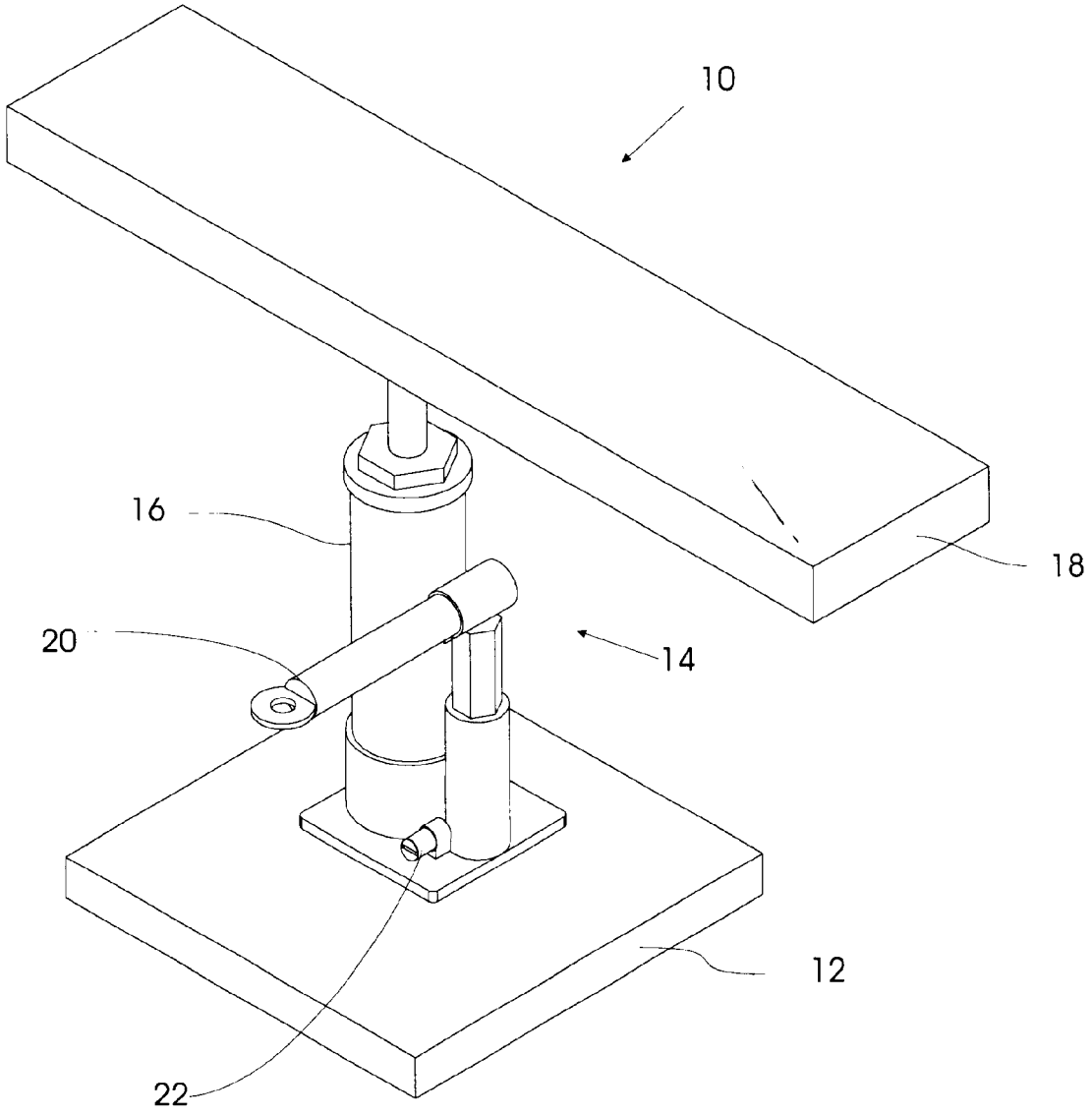
FIG. 1 is a perspective view of the cabinet installation device illustrating the first embodiment of the present invention.

With reference to the drawings in particular to FIGS. 1–5 thereof, the cabinet installation device, generally denoted by reference numeral 10, will be described herein. The present invention is a device designed and configured to facilitate the process of installing cabinets. As such, the present invention will raise, lower and support any size, type or style cabinets. This will allow for the user to make minute adjustments during the installation process.

This invention has been successfully utilized in the cabinet installation industry and has proven to be beneficial and extremely efficient when used for the installation of the upper cabinets. Using the present invention renders the installation of cabinets to be performed by a single installer, thereby providing for a one-man operation. The cabinet installation device of the present invention has proved to be successful and inherently reduces time, labor and damage generally associate with the cabinet installation process.

To allow for such an efficient installation device that allows for cabinets to be installed expeditiously and which provides for labor saving results, the present invention 10, as seen in FIG. 1, comprises a base 12 and secured to the base is the lifting, lowering and supporting assembly 14 known as the operational assembly.

In the preferred embodiment of the present invention, as seen in FIG. 1, secured to the top surface of the base, is the operational assembly. This operational assembly comprises a raising/lowering apparatus 16 and a support plate 18. The raising/lowering apparatus can be any conventional device having the capabilities of raising and lowering, such as the use of a jack, motor, pneumatically controlled bladder or the like. What has been utilized to produce favorably results is the use of conventional hydraulic jack. This hydraulic jack is shown through out the drawings and it is to understood by those skilled in the art that other raising/lowering apparatus can be used in its place to achieved desirable results.

Secured to the tip of the raising/lowering apparatus 16 is the support plate 18. The support plate 18, in the first embodiment of the present invention is designed and configured to receive the cabinet. Thus in operation of this first embodiment, the particular cabinet is placed on this support plate 18 and the user operates the particular raising/lowering apparatus 16 so as to enable the cabinet to be to raised and/or lower to the particular and desirable height. The support plate 18 will maintain the cabinet in any of the elevated positions.

Controlling and operating the raising/lowering apparatus 16 occurs via a handle 20 that is located thereon. The handle

20 is designed and configured to be operational via the foot or hand of the user. This will provide for easy access and manipulation of the raising/lowering apparatus. A second handle 22 or pedal can be provided for lowering the apparatus. This will provide the user two separate instruments wherein each instrument device a separate movement. Seizing contact with each instrument will provide for the lifting/lowering apparatus to seize operation.

Thereby providing for the purpose of the handle to raise the device, thus depressing the handle causes upward motion. Seizing the movement on the handle provides for the lifting/lowering of the apparatus and stops its upward ascend. Thereby providing for the support plate 18 to support the cabinet. To enable the cabinet and/or support plate to move in a downward direction, the pedal or second handle 22 is preferably utilized. This or second handle 22, is also designed to comfortably receive the user's hand or foot. Upon pressing, this pedal provides for the support plate to move downward. Thereby, it is seen that both the first and second handles are preferably flat.

Figure 2A:
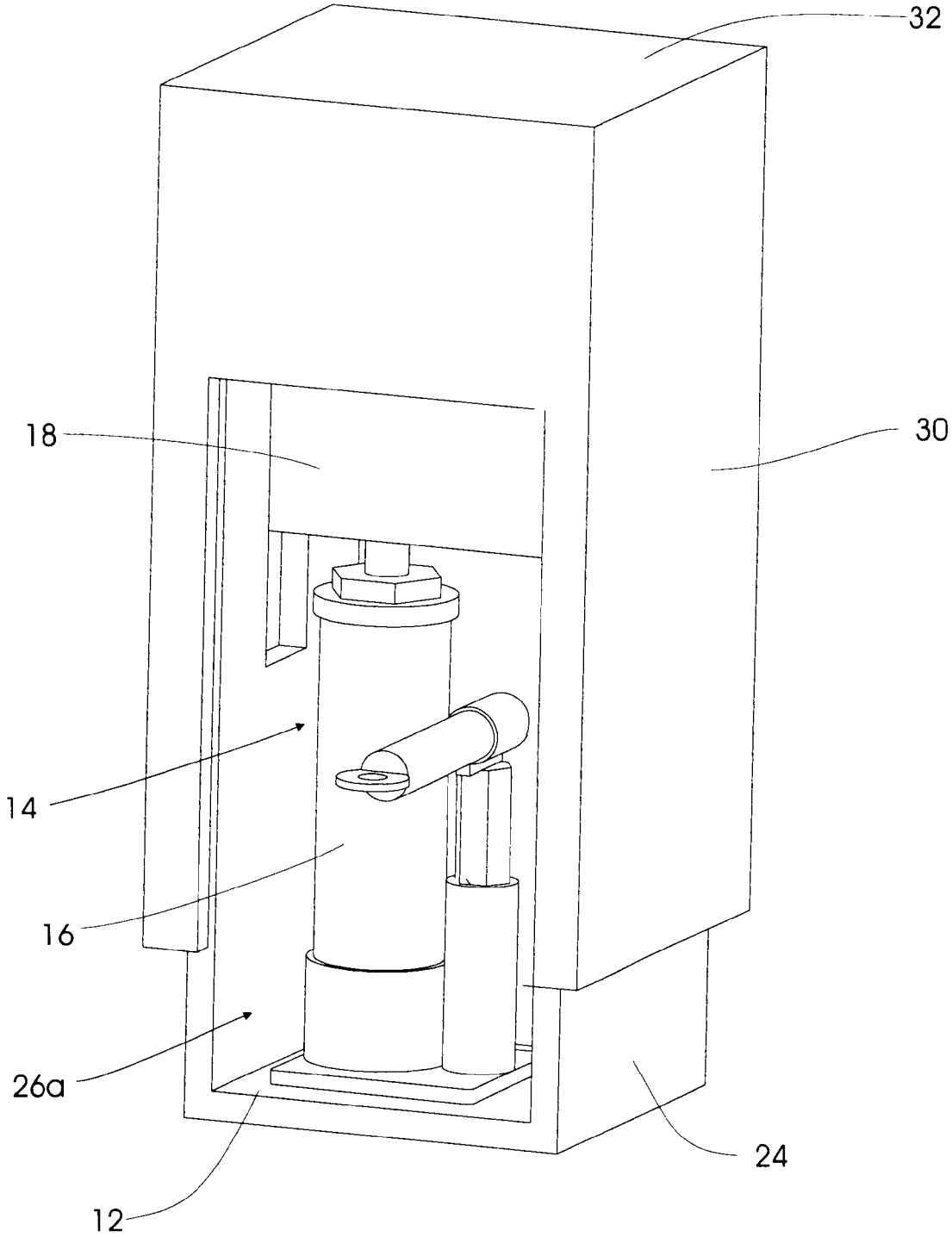
FIG. 2*a* is a perspective view of the cabinet installation device illustrating the second embodiment of the present invention in a downward position, ready for use and/or storage.
Figure 2B:
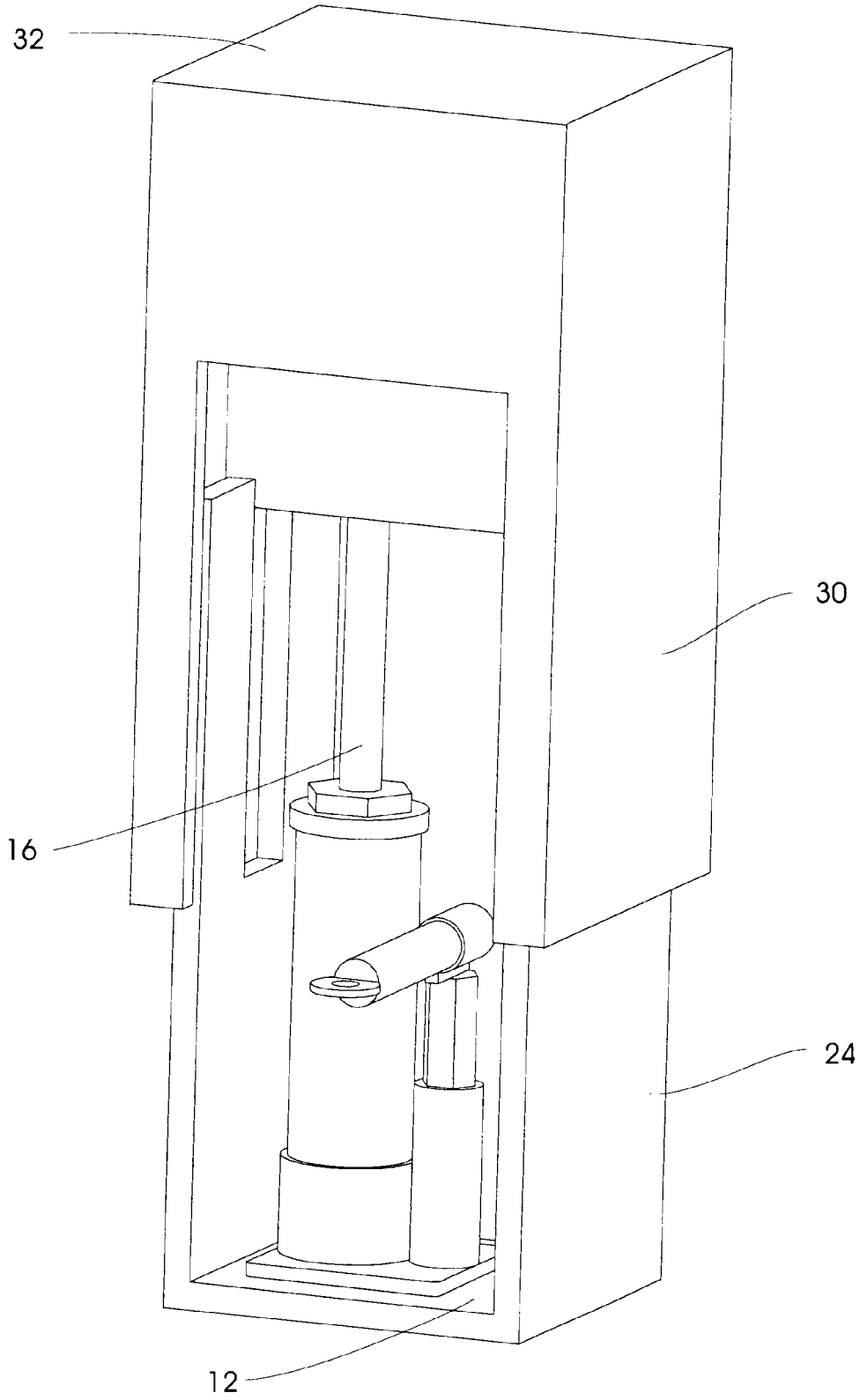
FIG. 2*b* is a perspective view of the cabinet installation device illustrating the second embodiment of the present invention in a lifted and useable position.
Figure 2C:
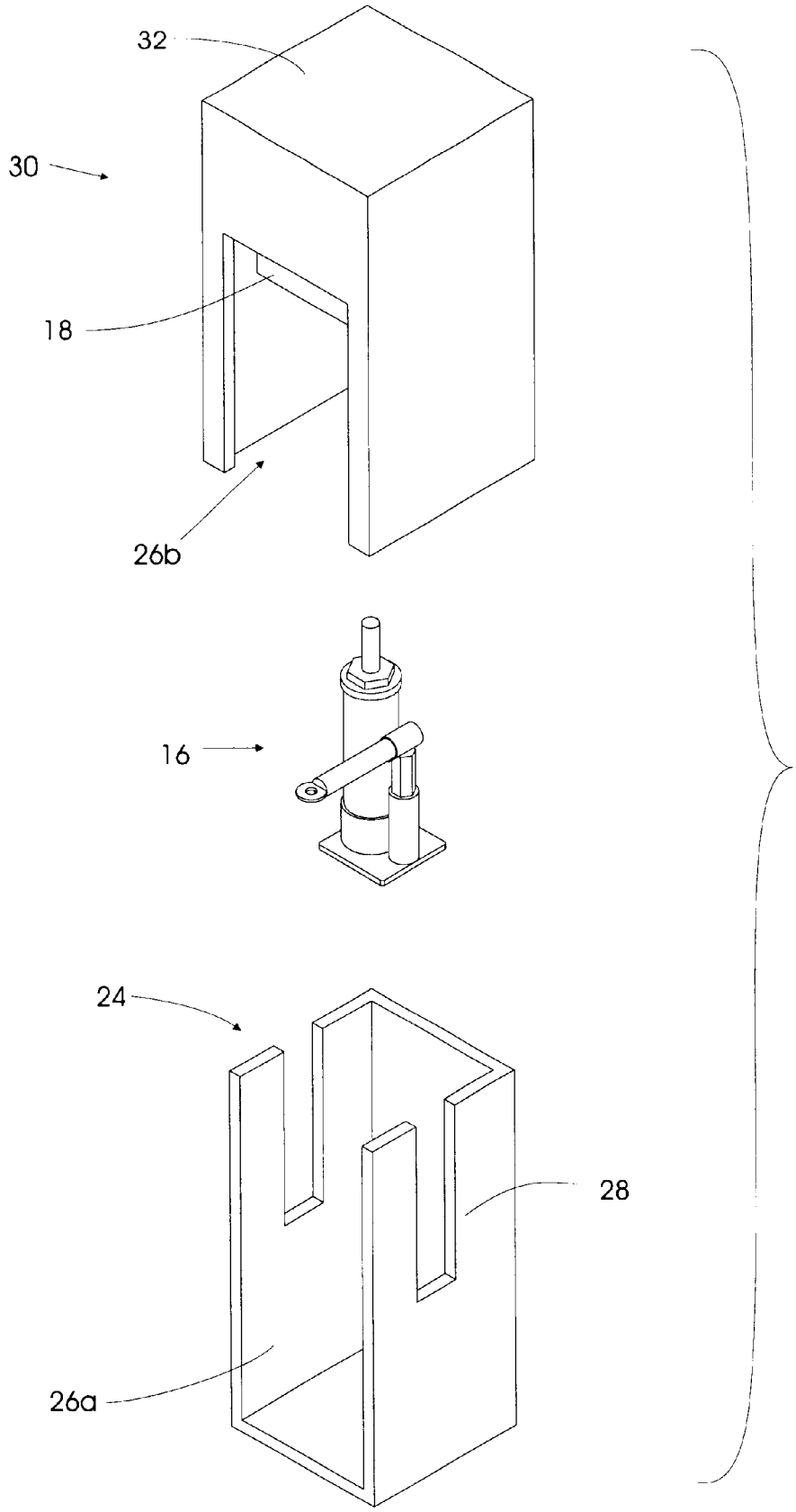
FIG. 2*c* is an exploded view of the cabinet installation device illustrating the second embodiment of the present invention.
Figure 3:
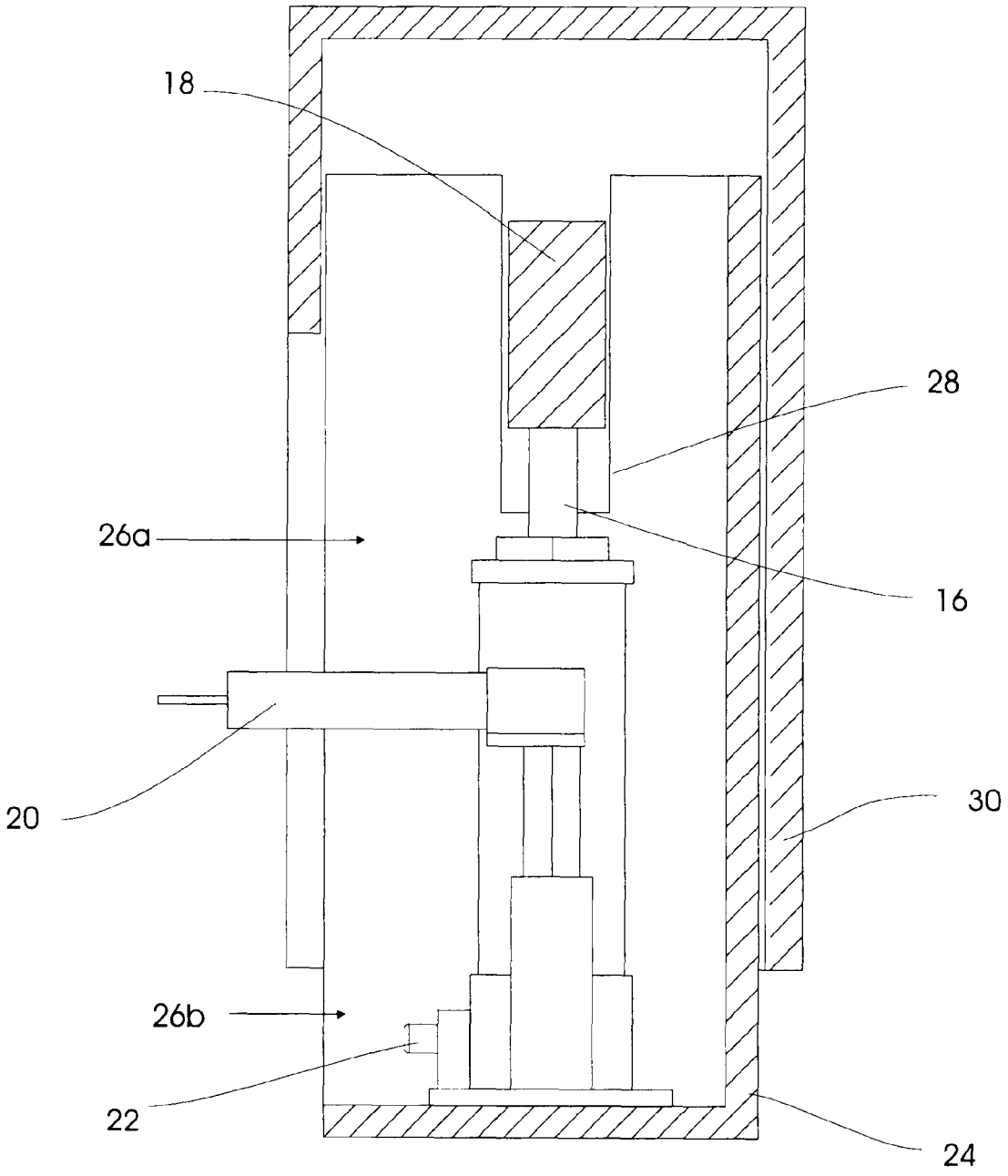
FIG. 3 is a cross-sectional view of cabinet installation device of the present invention taken along lines 3—3 and illustrating an example of the lifting and lower assembly housed therein.

Additional structural support can be provided by adding a sleeve that is secured to the support plate 18 and a guide assembly that is secured to the base 12. This additional sleeve and guide provides for the second embodiment and the preferred embodiment of the present invention and is illustrated in FIGS. 2*a*–3. As seen in FIGS. 2*a*–4, the present invention 10 further includes a guide assembly 24 that extends upwardly from the base 12 and houses the raising/lowering apparatus 16.

The guide assembly 24 includes an access 26*a* that allows access to the first and second handles 20 and 22, respectively. This will allow the user to operate the present invention 10, while enabling a means to access and manipulate the operational assembly 14 via the handles. The guide includes an open top that enables the support plate 18 to extend therethrough when at its highest point. The support plate 18 is secured to the inner surface of the sleeve and thus the guide assembly 24 includes channels 28. The outer ends of the support are designed to extend through the channels and be secured to the inner surface of the sleeve. This will enable the sleeve to slide upward and/or downward due to the support 18 being secured thereto and traveling along the channels. Thereby providing a more controlled ascending and descending motion.

The sleeve 30 extends over the guide assembly 24 and includes an open bottom. This open bottom is placed over the guide assembly. Extending through the sleeve is an access 26*b* that enables access to the first and second handles 20 and 22, respectively. When in the downward position, known as the useable or storable position, this access 26*b* will be alignable with the access of the guide assembly 24. Thereby allowing easy access for operating the present invention. Located at the top of the sleeve 30 is an enclosed top wall 32. This top wall acts as a support base and is designed to receive and maintain the desired cabinet for installation.

Figure 5:
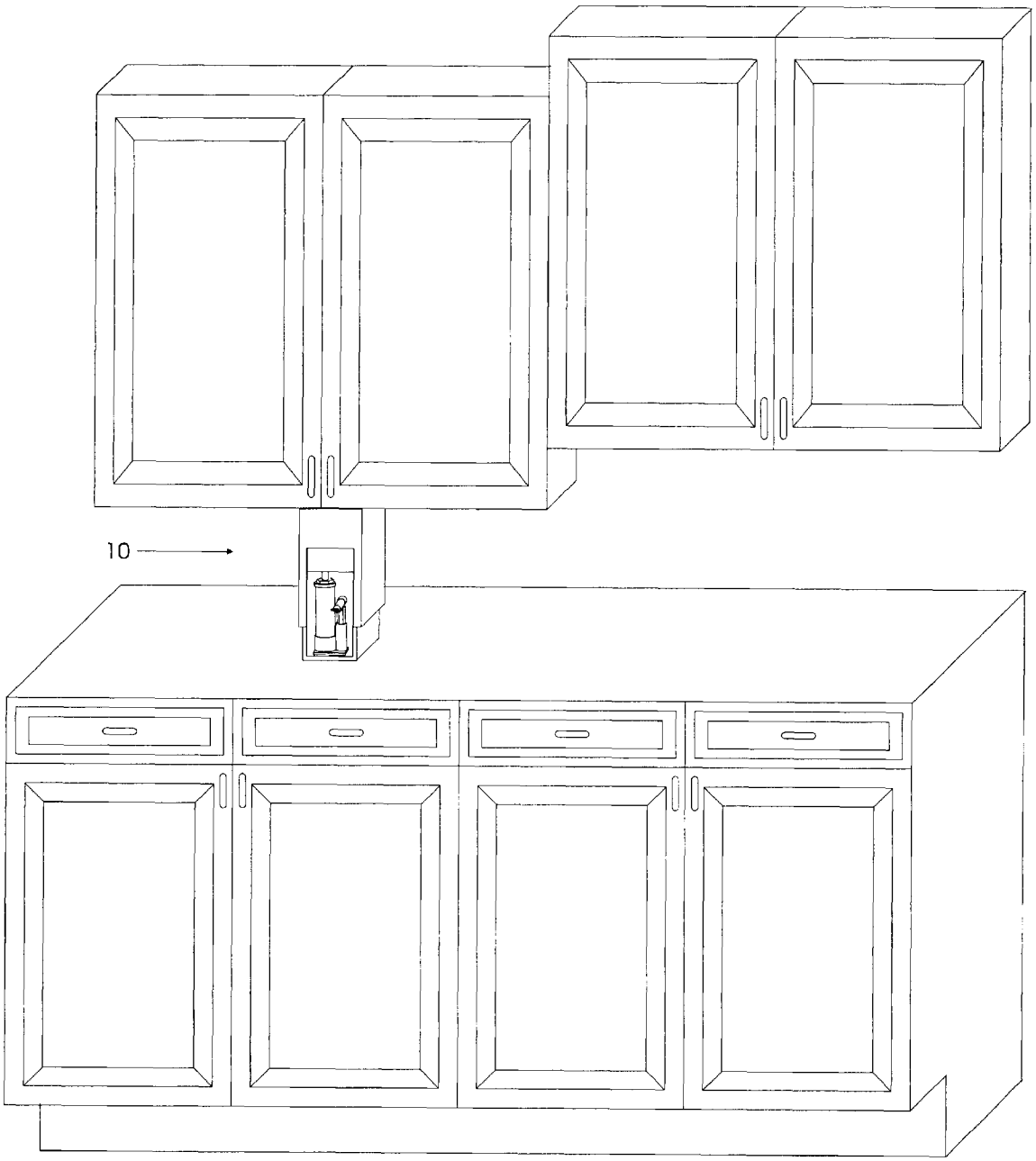
FIG. 5 is a front view illustrating the present invention in use.

To utilize the present invention 10, as seen in FIG. 5, the operational assembly 14 is lowered to its lowest position. The desired cabinet, which is to be installed, is placed on the top wall 32 of the sleeve 30. The lifting/lowering assembly 16 is activated via the particular handles 20 and/or 22 in order to raise and adjust the assembly to the desired position. Once the desired position is met, the operation of the handles seizes and the sleeve is used as a support for supporting the particular cabinet. This particular cabinet is installed as deemed appropriate by the installer. When secured, the present invention is lowered for additional use or storage.

Generally when installing cabinets, the counter tops are have not been installed, thereby providing for the lower cabinets to be open and not covered by counter tops. In this situation, the present invention can be placed on a board that extends the entire length of the lower cabinets or optionally, the base of the present invention can be sized so as to accommodate for such a situation.

For enhancing the present invention, a height adjuster can be utilized. This height adjuster 34 is shown in FIG. 4 and its purpose is to provide additional height when necessary, such as when the lower cabinets are not installed or when installing cabinets located above a refrigerator, washer, dryer or the like.

Due to its unique design, the present invention can be located within this height adjuster 34 or optionally on the top surface of the height adjuster 34. This height adjuster 34 includes substantially the same shape as the guide in combination with the base as well as the sleeve assembly shown in FIGS. 2*a*–3, only larger in scale.

Figure 4:
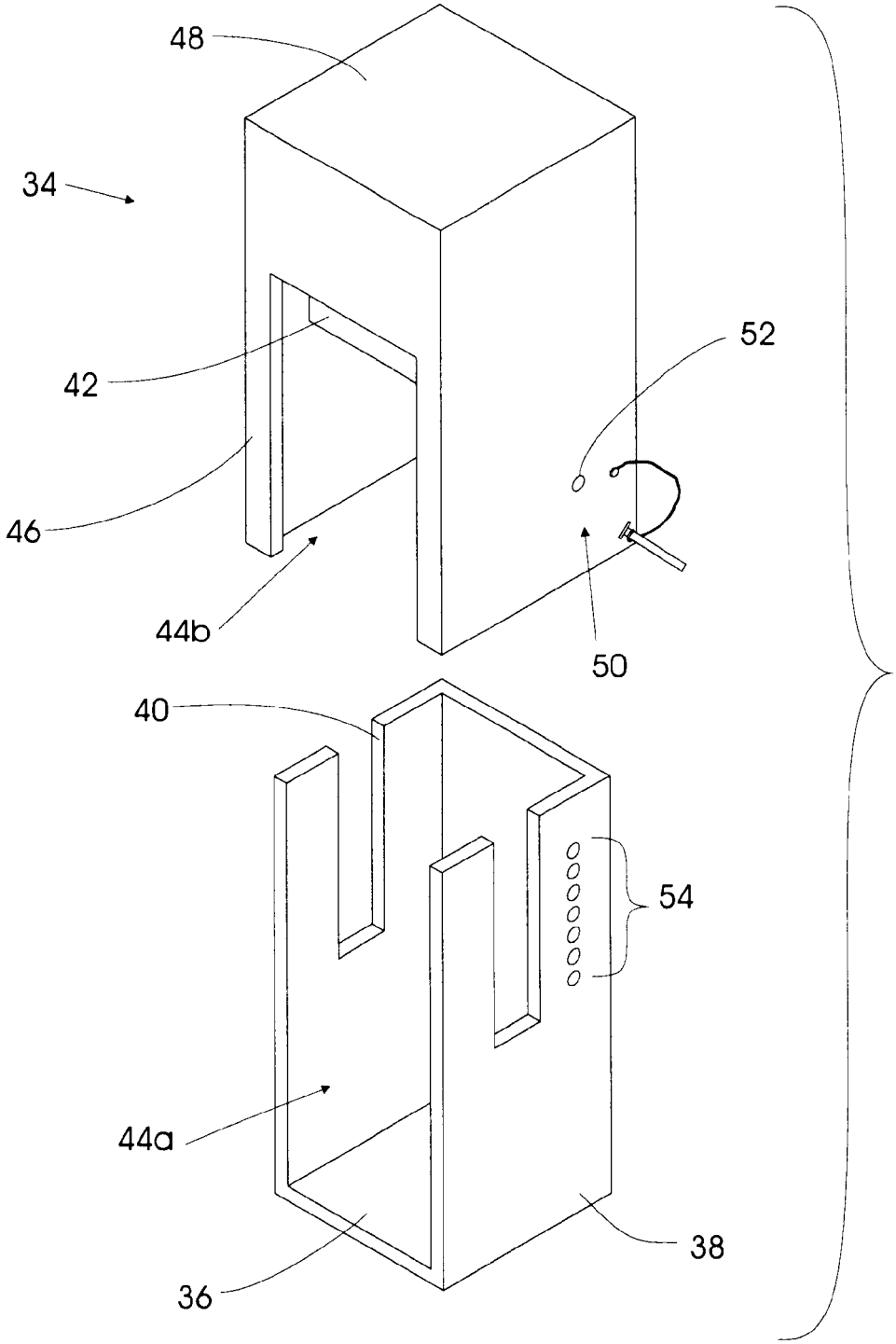
FIG. 4 is a perspective view of the height adjuster of used with the cabinet installation device of the present invention.

Thus, as seen in FIG. 4 the adjuster 34 comprises a base 36 having a guide assembly 38 attached thereto. The guide assembly includes an open top and extending though the guide is a pair of channels 40. The channels are designed to receive a bar 42. This bar 42 extends through the guide and is secured to the inner surface of the sleeve assembly. Also extending through the guide is an access 44*a*. This access will allow for the present invention 10 to be placed on the base 36 though the access.

The sleeve 46 extends over the guide assembly 38 and includes an open bottom. This open bottom is placed over the guide assembly. Extending through the sleeve is an access 44*b* that enables access to the base so as to enable access to the present invention 10 when located on the base 36 and within the guide assembly 38. Located at the top of the sleeve 46 is an enclosed top wall 48. This top wall acts as a support base and is designed to receive and maintain the desired cabinet for installation and/or is also designed to receive and maintain the present invention 10. Secured to the inner surface of the sleeve 46 is the bar 42. The bar 42 extends through the guide assembly via the channels 40 located therein. Thus, enabling vertically movement via the channels.

In use the present invention can be place within the access 44*a* and 44*b* of the adjuster 34 so as to provide for the base 36 to maintain the present invention 10. The access 44*a* and 44*b* will inherently provide access to the handles 20 and 22 of the present invention. During operation of the operational assembly 14, the support plate 18 will extend upward. This upward movement will cause support plate 18 to contact the bar 42 and thus cause the sleeve of the adjuster 34 to move vertically and achieve higher heights.

Alternatively, the present invention can be placed on the enclosed wall 48 of the sleeve 46 of the adjuster 34. Optionally, if even higher heights are desired, then the adjuster can include a height adjusting capabilities. As seen in the drawings, this height adjusting capability includes a locking assembly. In this configuration, the user lifts the sleeve 46 upward to a desired height. Once that height is achieve the sleeve 46 is locked to the guide assembly 38 via the locking assembly 50. Once locked, the present invention is placed on the top enclosed wall of the sleeve.

The locking assembly 50 can be any conventional locking assembly. Shown is the use of a pin and extending though the sleeve 46 is an aperture 52. Extending though the side wall of the guide assembly 38 is a plurality of apertures 54 that are alignable with the aperture of the sleeve 46. Once the desired height is achieved, a pin is inserted within the aperture 52 of the sleeve assembly and through an aligned hole of the guide assembly. This will allow for the sleeve to be in a locked position. To avoid losing the pin, the pin can be secured to the outer surface of the sleeve 46.

In essence, the present invention 10 is compact, light in weight, and simple apparatus that in operation provides an efficient and effective means of installing cabinets. Due to its design, cabinet installation can also occur by-way of a one-man operation. Inherently reducing the time, costs and man-power generally associated with cabinet installation.

While the invention has been particularly shown and described with reference to the various embodiments thereof, it will be understood by those skilled in the art that various changes in form and detail may be made without departing from the spirit and scope of the invention.

I claim:

1. A cabinet installation device comprising:

a base;

an operational assembly providing lifting, lowering, and supporting abilities;

said operational assembly is secured to said base; and said operational assembly comprises a support plate and a lifting/lowering apparatus; and wherein a guide assembly is secured to said base, a sleeve is secured to said support plate, said guide assembly and said sleeve provide added structural stability and said guide enables said sleeve to travel vertically, and wherein said guide assembly and said sleeve each include an access for enabling access to said operational assembly, and wherein outer ends of said support plate are secured to an inner surface of said sleeve and said guide assembly includes a pair of channels extending therethrough and said support plate extends through said channels.

2. A cabinet installation device comprising:

a base;

an operational assembly providing lifting, lowering, and supporting abilities;

said operational assembly is secured to said base; and said operational assembly comprises a support plate and a lifting/lowering apparatus; and wherein a guide assembly is secured to said base, a sleeve is secured to said support plate, said guide assembly and said sleeve provide added structural stability and said guide enables said sleeve to travel vertically, and wherein said guide assembly and said sleeve each include an access for enabling access to said operational assembly; and wherein said sleeve includes a top enclosed wall and an open bottom wall for receiving said guide assembly; and wherein outer ends of said support plate are secured to an inner surface of said sleeve and said guide assembly includes a pair of channels extending therethrough and said support plate extends through said channels.

3. The cabinet installation device in claim 2 wherein said lifting/lowering apparatus is a conventional hydraulic jack.

4. The cabinet installation device in claim 3 wherein said operation assembly includes a first handle for controlling upward movement and a second handle for controlling downward movement.

* * * * *